US009358427B2

(12) United States Patent
Maxwell

(10) Patent No.: US 9,358,427 B2
(45) Date of Patent: Jun. 7, 2016

(54) GOLF BALL HAVING WINDINGS CONTAINING A HIGHLY NEUTRALIZED ACID POLYMER

(75) Inventor: Kerby LaVar Maxwell, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1028 days.

(21) Appl. No.: 13/348,418

(22) Filed: Jan. 11, 2012

(65) Prior Publication Data

US 2013/0178309 A1 Jul. 11, 2013

(51) Int. Cl.

| | |
|---|---|
| ***A63B 37/06*** | (2006.01) |
| ***A63B 37/02*** | (2006.01) |
| ***A63B 37/00*** | (2006.01) |
| *A63B 37/08* | (2006.01) |
| *A63B 45/00* | (2006.01) |

(52) U.S. Cl.

CPC ..... *A63B 37/02* (2013.01); *A63B 37/0003* (2013.01); *A63B 37/0053* (2013.01); *A63B 37/0072* (2013.01); *A63B 37/0076* (2013.01); *A63B 37/0039* (2013.01); *A63B 37/0045* (2013.01); *A63B 37/0049* (2013.01); *A63B 37/08* (2013.01); *A63B 45/00* (2013.01); *A63B 2037/087* (2013.01)

(58) Field of Classification Search

CPC ..... A63B 37/0053
USPC ..... 473/356, 357, 362
See application file for complete search history.

(56) References Cited

U.S. PATENT DOCUMENTS

| | | | | |
|---|---|---|---|---|
| 5,155,157 | A | 10/1992 | Statz et al. | |
| 6,497,630 | B1 * | 12/2002 | Hebert et al. | 473/357 |
| 6,500,076 | B1 * | 12/2002 | Morgan et al. | 473/361 |
| 6,802,785 | B2 | 10/2004 | Jordan et al. | |
| 6,953,820 | B2 * | 10/2005 | Statz et al. | 524/322 |
| 7,115,049 | B2 | 10/2006 | Sullivan et al. | |
| 7,230,045 | B2 | 6/2007 | Rajagopalan et al. | |
| 7,365,128 | B2 | 4/2008 | Sullivan | |
| 7,452,289 | B2 | 11/2008 | Comeau | |
| 7,927,524 | B2 | 4/2011 | Vora et al. | |
| 2006/0293464 | A1 | 12/2006 | Rajagopalan et al. | |
| 2007/0105661 | A1 | 5/2007 | Rajagopalan et al. | |
| 2008/0254913 | A1 | 10/2008 | Morgan | |
| 2010/0240468 | A1 | 9/2010 | Rajagopalan et al. | |

FOREIGN PATENT DOCUMENTS

| | | |
|---|---|---|
| JP | 2008055173 | 3/2008 |

* cited by examiner

*Primary Examiner* — Raeann Gorden
(74) *Attorney, Agent, or Firm* — Honigman Miller Schwartz and Cohn LLP

(57) ABSTRACT

A golf ball having windings of strands made of a highly neutralized acid polymer is disclosed. The presence of a high acid content may cause the highly neutralized acid polymer to exhibit certain material properties. For example, the high acid content may cause an increased hardness and an increased flexural modulus. A high hardness may result in a golf ball exhibiting increased distance off the tee, or increased COR, among other desirable play characteristics. The hardness of the golf ball corresponds with the feel of the golf ball. The construction of a golf ball including wound strands may provide a soft feel. Thus, providing windings of bands made from a highly neutralized acid polymer may provide a golf ball with an increased distance off the tee and a soft feel.

7 Claims, 2 Drawing Sheets

GOLF BALL HAVING WINDINGS CONTAINING A HIGHLY NEUTRALIZED ACID POLYMER

BACKGROUND

The present invention relates generally to golf balls. In particular, the present disclosure relates to a golf ball made with windings containing a highly neutralized polymer.

Modern golf balls are known to be made from a variety of polymer materials. The material making up a golf ball may affect the golf ball's performance characteristics in several ways. For example, the selection of the material for use as a golf ball may affect the golf ball's coefficient of restitution, initial velocity off the tee, feel, durability over time, and other properties. Similarly, the construction of a golf ball may affect the golf ball's performance. Thus, it would be advantageous to make a golf ball having both a material and a construction selected to enhance the golf ball's performance characteristics.

SUMMARY

In one aspect, the disclosure provides a golf ball having at least one strand made of at least one highly neutralized acid polymer. The strand may be wound under tension to form a wound layer. A cover layer may surround the wound layer. The at least one strand may include at least one of HPF1000, HPF2000, HPF AD1024, HPF AD1027, HPF AD1030, HPF AD1035, and HPF AD1040. The at least one strand may include at least two of HPF1000, HPF2000, HPF AD1024, HPF AD1027, HPF AD1030, HPF AD1035, and HPF AD1040. The wound layer may be a core layer. The at least one strand may include a core bead disposed at one end. The at least one strand may be wound around the core bead under tension to form a core layer. The golf ball may include a first solid core layer. The wound layer may surround the first solid core layer. The golf ball may include a second solid layer surrounding the wound layer. The entire golf ball may be formed from at least one of HPF1000, HPF2000, HPF AD1024, HPF AD1027, HPF AD1030, HPF AD1035, and HPF AD1040. The golf ball may include a liquid core surrounded by the wound layer.

In one aspect, the disclosure provides a golf ball having a core layer. The golf ball may have at least one strand made of at least one highly neutralized acid polymer. The strand may be wound under tension around the core layer to form a wound layer. The golf ball may include a cover layer surrounding the wound layer. The core layer and the cover layer may each be formed from one or more highly neutralized acid polymers. The at least one strand may include at least one of HPF1000, HPF2000, HPF AD1024, HPF AD1027, HPF AD1030, HPF AD1035, and HPF AD1040. The at least one strand may include a first highly neutralized acid polymer and a second highly neutralized acid polymer. The ratio of the first highly neutralized acid polymer to the second highly neutralized acid polymer may range from 20:80 to 80:20.

In one aspect, the disclosure provides a golf ball having a solid layer. The at least one strand may be made of at least one highly neutralized acid polymer. The strand may be wound under tension to form a wound layer. The at least one strand may include a core bead disposed at one end and the at least one strand is wound around core bead under tension to form a core layer. The solid layer may surround the wound layer. The wound layer may surround the solid layer.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
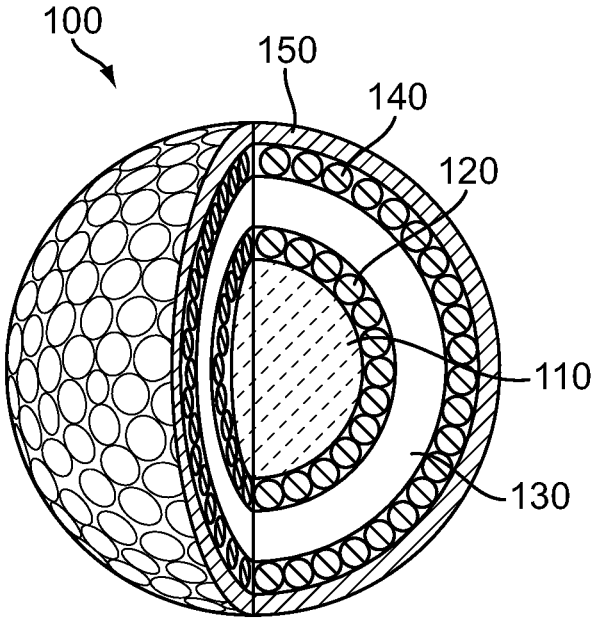
FIG. 1 is a golf ball according to an embodiment.

A golf ball having windings of strands made of a highly neutralized acid polymer is disclosed. The presence of a high acid content may cause the highly neutralized acid polymer to exhibit certain material properties. For example, the high acid content may cause an increased hardness and an increased flexural modulus. A high hardness may result in a golf ball exhibiting increased distance off the tee, increased spin, or increased COR, among other desirable play characteristics. The hardness of the golf ball corresponds with the feel of the golf ball. The construction of a golf ball including wound strands may provide a soft feel even though the material of the wound strand is relatively hard. Thus, providing windings of bands made from a highly neutralized acid polymer may provide a golf ball with an increased distance off the tee and a soft feel.

Highly neutralized acid polymers may be made from ionomers. An ionomer is generally understood as any polymer material that includes ionized functional groups therein. Ionomeric resins are often ionic copolymers of an olefin and a salt of an unsaturated carboxylic acid. The olefin may have from about 2 to about 8 carbon atoms, and may be an alpha-olefin. The acid may be an unsaturated monocarboxylic acid having from about 3 to about 8 carbon atoms, and may be an alpha, beta-unsaturated carboxylic acid. Commonly, ionomers are copolymers of ethylene and either acrylic acid or methacrylic acid. In some circumstances, an additional comonomer (such as an acrylate ester, i.e., iso- or n-butylacrylate, etc.) can also be included to produce a terpolymer. A wide range of ionomers are known to the person of ordinary skill in the art of golf ball manufacturing.

When a large portion of the acid groups in the ionomer is neutralized by a cation, the ionomer material may be considered to be a highly neutralized acid polymer. Generally, such a polymer is considered highly neutralized when at least 70% of the acid groups are neutralized by a cation. In various embodiments, the highly neutralized acid polymer may be neutralized to at least 75%, at least 80%, at least 85%, at least 90%, at least 95%, at least 98%, at least 99%, or substantially 100%.

The acid content of a highly neutralized acid polymer is defined as the percentage of the unsaturated carboxylic acid by weight relative to the total weight of the polymer. Generally, the acid content may range from 1% to 50%. In particular embodiments where the highly neutralized acid polymer has a "high" acid content, the acid content may be at least about 20%. In various embodiments, the high acid content may be at least about 21%, at least about 22%, at least about 23%, at least about 24%, at least about 25%, at least about 26%, at least about 27%, at least about 28%, at least about 29%, at least about 30%, at least about 31%, at least about 32%, at least about 33%, at least about 34%, at least about 35%, at least about 36%, at least about 37%, at least about 38%, at least about 39%, at least about 40%, at least about 41%, at least about 42%, at least about 43%, at least about 44%, at least about 45%, at least about 46%, at least about 47%, at least about 48%, at least about 49%, or about 50%.

In various other embodiments, the high acid content may fall within a desired specific range. For example, in various embodiments, the high acid content may be from about 20% to about 40%, from about 25% to about 40%, from about 30% to about 40%, from about 35% to about 40%, or from about 38% to about 40%.

In some embodiments, the highly neutralized acid polymer may include the blends and methods of making such blends described in U.S. patent application Ser. No. 13/194,094, entitled A Golf Ball Including a Blend of Highly Neutralized Acid Polymers and Method of Manufacture, applied for by Liu et al. and filed on Jul. 29, 2011, the disclosure of which is hereby incorporated by reference in its entirety.

FIG. 1 shows a golf ball 100 according to an embodiment. The golf ball may include a core layer 110, a first wound layer 120, a solid layer 130, a second wound layer 140, and a cover layer 150.

In some embodiments, core layer 110 may be liquid. Liquid cores are well known to those in the art. For example, core layer 110 may be made of a water, alcohol, or oil, optionally, with any of a variety of additives or fillers used to alter the viscosity of the liquid. In some embodiments, the liquid core may be encapsulated inside a chamber disposed within first wound layer 120. In some embodiments, the liquid core may be encapsulated by only first wound layer 120. In some embodiments, core layer 110 may be solid. For example, core layer 110 may be made of rubber, rubber composites, highly neutralized acid polymers, ionomers, or other polymer materials. The material used to make core layer 110 may be selected based on a variety of factors. For example, the material used to make core layer 110 may be selected based on the type of material used to make the other layers of the golf ball, the desired play characteristics of the golf ball, and/or the process used to make the other layers of the golf ball.

Core layer 110 may be made by any suitable process. For example, in some embodiments, a flexible chamber may be injected with a liquid or a gas to form a liquid or gas core layer. In other embodiments, a liquid may be frozen and first wound layer 120 may be wound around the frozen liquid before the liquid thaws to form a liquid core layer. In some embodiments, core layer 110 may be made by an injection molding process or a compression molding process to form a solid core layer. The process of making the core layer and the diameter of core layer may be selected based on a variety of factors. For example, the process of making the core layer and the diameter of core layer may be selected based on the type of material used to make the core layer and/or the process used to make the other layers.

First wound layer 120 may include one or more strands made of a highly neutralized acid polymer wound around core layer 110 under tension. For example, first wound layer 120 may be made of five to ten strands. Solid layer 130 may include a solid material surrounding first wound layer 120. Second wound layer 140 may include one or more strands made of a highly neutralized acid polymer wound around solid layer 130 under tension. For example, second wound layer 140 may be made of five to ten strands. Cover layer 150 may include a solid layer surrounding second wound layer 140.

In some embodiments, first wound layer 120 and second wound layer 140 may include the same construction. In some embodiments, first wound layer 120 and second wound layer 140 may include different constructions. Regarding first wound layer 120 and second wound layer 140, the number of strands, the length and thickness of the strands, the winding pattern of the strands, the number of windings, the tension of the wound strands, and the thickness of the layer created by the wound strands may be selected based on a variety of factors. For example, the number of strands, the length and thickness of the strands, the winding pattern of the strands, the number of windings, the tension of the wound strands, and the thickness of the layer created by the wound strands may be selected based on the features of the other layers and/or the desired play characteristics of the golf ball.

In some embodiments, first wound layer 120 and second wound layer 140 may each include one or more highly neutralized acid polymer compositions. For example, in the exemplary embodiments, first wound layer 120 and/or second wound layer 140 may include a first highly neutralized acid polymer composition and a second highly neutralized acid polymer composition. In some embodiments, the ratio of the first highly neutralized acid polymer composition to the second highly neutralized acid polymer composition may range from 0:100 to 100:0. In another embodiment, the same ratio may range from 20:80 to 80:20. In another embodiment, the same ratio may range from 30:70 to 70:30. In another embodiment, the same ratio may range from 40:60 to 60:40. In yet another embodiment, the same ratio may be 50:50. In some embodiments, two highly neutralized acid polymer compositions each having a flexural modulus of less than 35,000 psi may be used to make first wound layer 120 and/or second wound layer 140. In some embodiments, two highly neutralized acid polymer compositions each having a Vicat softening temperature of from 50° C. to 60° C., or 52° C. to 58° C. may be used to make first wound layer 120 and/or second wound layer 140. In some embodiments, suitable materials for first wound layer 120 and/or second wound layer 140 may include the following highly neutralized acid polymer compositions: HPF resins such as HPF1000, HPF2000, HPF AD1024, HPF AD1027, HPF AD1030, HPF AD1035, HPF AD1040, all produced by E. I. Dupont de Nemours and Company.

The highly neutralized acid polymer composition used to make first wound layer 120 and/or second wound layer 140 may be selected based on a variety of factors. For example, the highly neutralized acid polymer composition used to make first wound layer 120 and/or second wound layer 140 may be selected based on the features of the other layers and/or the desired play characteristics of the golf ball.

In some embodiments, solid layer 130 and/or cover layer 150 may be made from a thermoplastic material including at least one of an ionomer resin, a highly neutralized acid polymer composition, a polyamide resin, a polyester resin, and a polyurethane resin. In some embodiments, solid layer 130 may include the same type of material as cover layer 150. In some embodiments, solid layer 130 may include a different type of material from cover layer 150. The materials used to make solid layer 130 and cover layer 150 and the thicknesses of solid layer 130 and cover layer 150 may be selected based on a variety of factors. For example, the materials used to make solid layer 130 and cover layer 150 and the thicknesses of solid layer 130 and cover layer 150 may be selected based on the features of the other layers and/or the desired play characteristics of the golf ball.

While the embodiment of golf ball 100 shown in FIG. 1 has been described and illustrated as having five layers, other embodiments may include any number of layers. In some embodiments, the layers shown in FIG. 1 may be eliminated and/or more layers may be added. For example, in some embodiments, golf ball 100 may include four layers. In such an embodiment, second wound layer 140 may be eliminated and the thicknesses of the other layers may be adjusted to compensate for the absence of second wound layer 140. For example, first wound layer 120 and/or solid layer 130 may be thicker to compensate for the space left by the absence of second wound layer 140. In some embodiments, first wound layer 120 may be eliminated and the thicknesses of the other layers may be adjusted to compensate for the absence of first wound layer 120. For example, solid layer 130 and/or second wound layer 140 may be thicker to compensate for the space left by the absence of first wound layer 120. In some embodiments, golf ball 100 may include three layers. In such embodiments, solid layer 130 may be eliminated and first wound layer 120 and second wound layer 140 may be combined to form a single wound layer filling the space between core layer 110 and cover layer 150. In some embodiments, golf ball 100 may simply include a wound core layer covered by cover layer 150. In some embodiments, golf ball 100 may include more than five layers. For example, core layer 110 may include an inner core layer and an outer core layer. The number of layers of golf ball 100 may be selected based on a variety of factors. For example, the number of layers may be selected based on the type of materials use to make the golf ball and/or the size of the golf ball.

In some embodiments, all of the layers of golf ball 100 may include a highly neutralized acid polymer. In some embodiments, all of the layers of golf ball 100 may include the same type of highly neutralized acid polymer such that golf ball 100 is made entirely of the same material.

Figure 2:
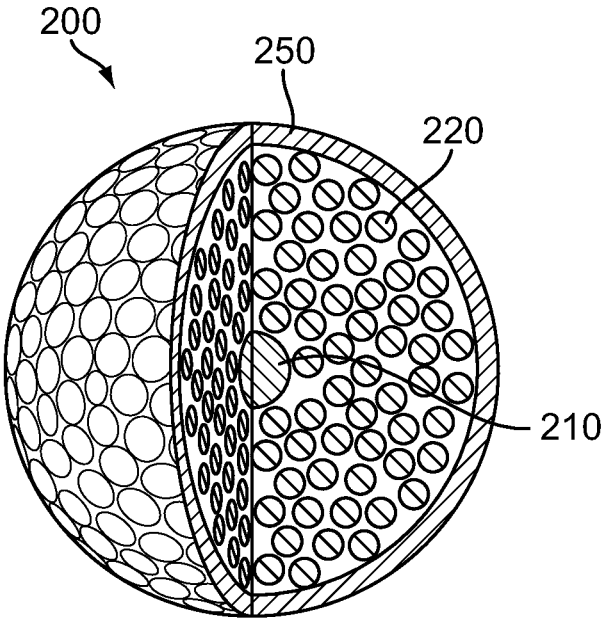
FIG. 2 is a golf ball according to an embodiment.
Figure 3:
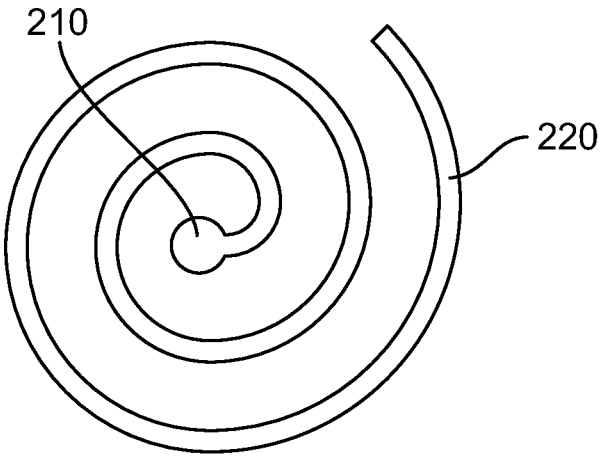
FIG. 3 is an isolated view of the strand used to form the wound core layer of the golf ball of FIG. 2.

FIGS. 2-3 show a golf ball 200 according to another embodiment. Golf ball 200 may include a wound core layer surrounded by a cover layer 250. FIG. 3 is an isolated view of strand 220 used to form the wound core layer of the golf ball of FIG. 2. Strand 220 may include an elongated strand having a core bead 210 disposed at one end. In some embodiments, core bead 210 may include a substantially spherical shape. In other embodiments, core bead 210 may include other shapes. In some embodiments, core bead 210 may include a smooth surface. In some embodiments, core bead 210 may include a spiked outer surface. In some embodiments, the portion of strand 220 extending from core bead 210 may have a uniform cross-section throughout its length. In other embodiments, the portion of strand 220 extending from core bead 210 may have a cross-section that tapers throughout its length. For example, the portion may taper from core bead 210 to the end of the portion opposite core bead 210.

In some embodiments, strand 220 may be wound around core bead 210 multiple times under tension to form a wound core layer. In some embodiments, core bead 210 may be disposed in the center of golf ball 200. The diameter of core bead 210, the length and thickness of strand 220, the winding pattern of strand 220, the number of windings, the tension of the strand windings, and the thickness of the layer created by strand 220 wound around core bead 210 may be selected based on a variety of factors. For example, the diameter of core bead 210, the length and thickness of strand 220, the winding pattern of strand 220, the number of windings, the tension of the strand windings, and the thickness of the layer created by strand 220 wound around core bead 210 may be selected based on the features of the other layers and/or the desired play characteristics of the golf ball.

Strand 220 and core bead 210 may made of a highly neutralized acid polymer. Strand 220 and core bead 210 may include any of the materials listed above as options for first wound layer 120 and second wound layer 140. The highly neutralized acid polymer composition used to make strand 220 and core bead 210 may be selected based on a variety of factors. For example, the highly neutralized acid polymer composition used to make strand 220 and core bead 210 may be selected based on the features of the other layers and/or the desired play characteristics of the golf ball.

Strand 220 and core bead 210 may be made by any suitable process. For example, in some embodiments, strand 220 and core bead 210 may be made by an injection molding process, a compression molding process, an extrusion process, and/or a combination of these processes. The process of making strand 220 and core bead 210 may be selected based on a variety of factors. For example, the process of making strand 220 and core bead 210 may be selected based on the type of material used to make strand 220 and core bead 210 and/or the process used to make the cover layer.

While the embodiment of golf ball 200 shown in FIG. 2 has been described and illustrated as having a wound core layer surrounded by a cover layer, other embodiments may include additional layers. For example, in some embodiments, golf ball 200 may include a solid layer disposed between the wound core layer and cover layer 250. In such an embodiment, the thickness of the wound core layer and/or cover layer 250 may be adjusted to compensate for this additional solid layer. For example, the diameter of the wound core layer may be reduced to compensate for the space taken up by the additional solid layer. In some embodiments, golf ball 200 may include a solid layer surrounding the wound core layer and a wound layer disposed between the solid layer and cover layer 250. In such an embodiment, the thickness of the wound core layer and/or cover layer 250 may be adjusted to compensate for the additional solid and wound layers. For example, the diameter of the wound core layer may be reduced to compensate for the space taken up by the additional solid and wound layers.

In some embodiments, all of the layers of golf ball 200 may include a highly neutralized acid polymer. In some embodiments, all of the layers of golf ball 200 may include the same type of highly neutralized acid polymer such that golf ball 200 is made entirely of the same material.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A golf ball comprising:

a solid layer; and at least one strand made of at least one highly neutralized acid polymer, the strand being wound under tension to form a wound layer;

wherein the at least one highly neutralized acid polymer has a flexural modulus of less than 35,000 psi.

2. The golf ball according to claim 1, wherein the wound layer is a core layer.

3. The golf ball according to claim 2, wherein the at least one strand includes a core bead disposed at one end.

4. The golf ball according to claim 3, wherein the at least one strand is wound around the core bead under tension to form a core layer.

5. The golf ball according to claim 1, further comprising a first solid core layer.

6. The golf ball according to claim 5, wherein the wound layer surrounds the first solid core layer.

7. The golf ball according to claim 6, further comprising a second solid layer surrounding the wound layer.

* * * * *